United States Patent [19]

Valenzona

[11] 4,212,408

[45] Jul. 15, 1980

[54] BEVERAGE DRINKING CONTAINER

[75] Inventor: Joseph F. Valenzona, Harbor City, Calif.

[73] Assignee: Orion Industries, Inc., Compton, Calif.

[21] Appl. No.: 957,528

[22] Filed: Nov. 3, 1978

[51] Int. Cl.[2] ..... A47G 19/22

[52] U.S. Cl. ..... 220/254; 220/90.4; 220/264; 220/293; 222/511; 222/518

[58] Field of Search ..... 222/515, 518, 511; 220/90.4, 254, 264, 293

[56] References Cited

U.S. PATENT DOCUMENTS

| | | | |
|---|---|---|---|
| 2,447,870 | 8/1948 | Polcyn | 220/90.4 |
| 3,964,631 | 6/1976 | Albert | 222/518 X |
| 3,967,748 | 7/1976 | Albert | 220/90.4 |
| 3,972,443 | 8/1976 | Albert | 220/90.4 |
| 4,094,433 | 6/1978 | Numbers | 220/90.4 |
| 4,099,642 | 7/1978 | Nergard | 220/90.4 |
| 4,133,446 | 1/1979 | Albert | 220/90.4 |

*Primary Examiner*—Allan N. Shoap

*Attorney, Agent, or Firm*—Fulwider, Patton, Rieber, Lee & Utecht

[57] ABSTRACT

A drinking container is provided with a removable cap engageable with a cup in sealing arrangement. A drinking opening is provided in the cap and is normally sealed shut by a spring biased plug. A trigger on the exterior of the cap, when actuated, withdraws the plug from the drinking opening to allow the user to imbibe a beverage.

3 Claims, 10 Drawing Figures

BEVERAGE DRINKING CONTAINER

BACKGROUND OF THE INVENTION

1. Field of the Invention

The present invention relates to covered beverage containers which prevent spilling or leakage even when subjected to jarring movement and when misaligned from an upright position. Such containers are especially useful for transporting beverages in automotive vehicles.

2. Description of the Prior Art

For many years the occupants of moving vehicles have attempted to carry beverage containers with them and to imbibe while driving or riding. It is the practice of many individuals to carry coffee, tea, and soft drinks in containers to sip while traveling in vehicles. However, because of the sway, vibration and bouncing movement encountered in most automobiles, trucks, trains, bicycles, and other vehicles, beverages frequently spill over the rim of a conventional open mouthed cup. Moreover, the motion transmitted from the vehicle will tilt and jostle a container, causing it to be upset from an otherwise stable upright position, and to spill on its side. The beverage is thus totally lost and unavailable for consumption. Also, such spillage creates a mess which is difficult to clean and which represents a source of extreme frustration and anoyance to travelers.

In the past, various remedies for this problem have been attempted. For example, the doors of automobile glove compartments are frequently provided with cup recesses in an attempt to add stability to beverage cups to prevent them from being spilled onto their sides. However, the shallow draft of such recesses which is practical in glove compartment doors limits the effectiveness of such systems. Restaurant establishments which sell food and beverages for consumption off the premises have for some time resorted to covered disposable cups so that the beverage might be taken from the premises without mishap. Sometimes the caps for such containers are equipped with weakened or precut areas through which straws may be inserted, so that a user may drink from such containers while traveling. However, to date such disposable containers have proven inadequate. The containers frequently leak at the interface of the cap and the cup rim. With the normal movement and impacts to the cab of a vehicle as the vehicle travels on a road, the beverage frequently leaks either onto the floor or seat area of the vehicle cab, or into other food items in the same package.

A further problem with conventional drinking containers sometimes used to confine beverages in traveling vehicles is that beverage spills, which so frequently occur, distract the vehicle driver's attention. The driver tends to concentrate inordinately on preventing spills, and thus partially diverts attention from driving. This represents an unsafe practice, but one which occurs with great frequeny. Moreover, when the liquid within the container is hot, such as hot coffee, liquid spilling over the side of the cup burns the fingers of a person holding the cup. This represents a considerable hazard since the individual holding the cup wishes to hurridly put the cup down in order to wipe the hot liquid from his fingers, but cannot do so without further inattention to driving. Moreover, the liquid in the container is likely to spill entirely if the cup is placed on the seat or floor since the individual holding the cup can no longer cushion it from road shocks and swaying movement.

A further disadvantage of conventional drinking containers, even those designed for transport, is their limited capability to provide both ready access for drinking, and ease of handling during transport. While conventional vaccum bottles or flasks are readily transportable and do prevent liquid leakage, the beverage within such a bottle can be removed for drinking only with considerable attention. Specifically, the plug on the bottle must be removed, usually by unscrewing, and the contents poured into a cup or a cap provided for the purpose, which must first be removed from the mouth of the vacuum container. This is a task which requires both hands of a user and one which cannot be performed by a person while driving a vehicle. As a consequence, vacuum bottles have heretofore represented a considerable source of inconvenience to a user who wishes only to sip intermittently on a liquid beverage while traveling.

SUMMARY OF THE INVENTION

It is an object of the present invention to provide a fully enclosed drinking container with a drinking aperture that can be temporarily unsealed with but a flick of the finger of a user. The enclosed container of the invention will not leak, even when carried or stored in a tilted or inverted position.

A further object of the invention is to provide a drinking container which can be held easily in one hand and which has a sealing valve or plug that can be operated by the fingers of the same hand while the user tilts the container to imbibe the beverage therein. By providing a container easily manipulated with one hand to open a drinking aperture and to concurrently tilt the container so that the beverage will flow out of the drinking aperture, the users other hand is entirely free to manipulate a steering wheel while driving an automotive vehicle.

Yet a further object of the invention is to provide a totally enclosed drinking container having a releasable plug in a drinking aperture which will automatically resume a sealing engagement upon release of an actuating trigger mechanism. Thus, unless the trigger mechanism is operated to allow the beverage to flow from the container through the drinking opening therein, the beverage is otherwise completely sealed within the container regardless of the container orientation. Even if the user drops the container, the beverage therein will not be spilled since the container will automatically seal itself.

Yet a further object of the invention is to provide an enclosed drinking container which the user can manipulate with one hand and which does not entail actuating mechanisms that interfere with the act of drinking. All of the operating components of the drinking container of the invention are located away from the exposed outer transverse surface of the cap in which the drinking opening is located. These mechanisms are therefore not thrust into the users face as he tilts the container to consume the beverage.

Yet an additional object of the invention is to provide a container with a removable cap which allows access to a cup having a wide mouth. This allows liquid to be easily introduced into the cup and thereafter closed with the cap. This construction also facilitates cleaning the container, since it can be easily separated for washing into two disconnected components. The wide mouth of the cup portion of the container does not restrict the cleansing action of a washcloth or dishwasher spray as do the narrow mouths of conventional vacuum bottles.

Because of its unique and convenient features, the drinking container of the present invention can be transported in any orientation within any automotive or marine vehicle, or within hiking or bicycle packs. Moreover, the container, because it is normally closed, prevents the contamination of the beverage by foreign elements. For example, the container can be used at a beach or in windy areas, and will prevent the entry of sand or windblown debris.

The invention may be explained with greater clarity and particularity through a description of the embodiment of the invention, which is depicted in the accompanying drawings.

DESCRIPTION OF THE EMBODIMENT

Figure 1:
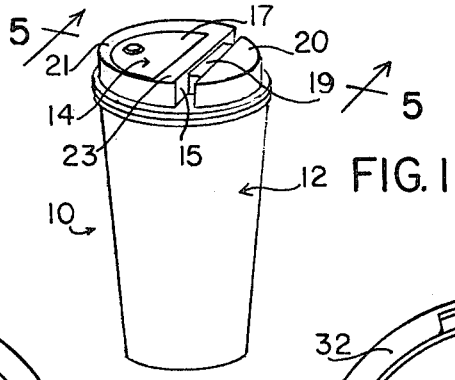
FIG. 1 is a perspective view of one embodiment of the drinking container of the invention.
Figure 5:
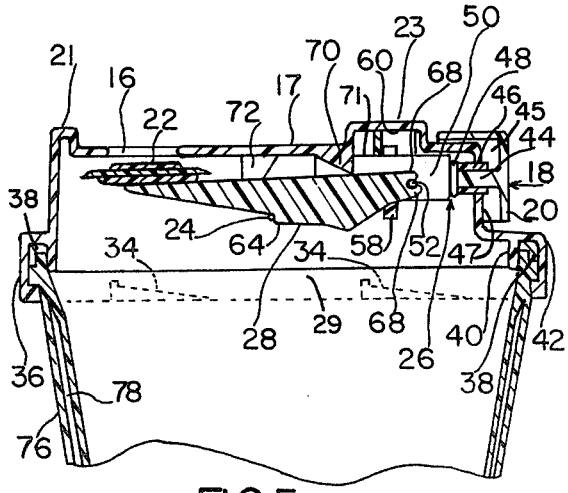
FIG. 5 is a partial elevational section taken along the lines 5—5 of FIG. 1 when the drinking opening is unsealed.
Figure 6:
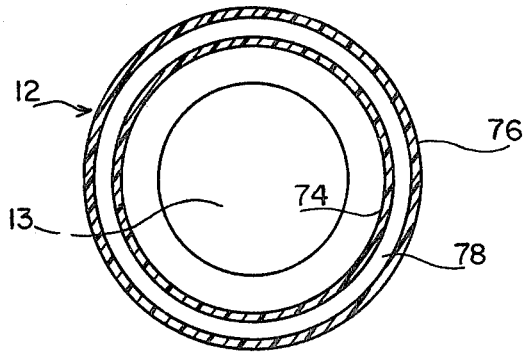
FIG. 6 is a section taken through the cup along the lines 6—6 of FIG. 4.

A tall tapered drinking container 10 is depicted in FIG. 1. The drinking container 10 is totally enclosable and has a tapered molded plastic cup 12, closed at its bottom end 13 and of circular cross section throughout, as depicted in FIG. 6 and having a circular upper lip 29 at its open mouth, depicted in FIGS. 4 and 5. A disk-like molded plastic cap 14 is removably positioned atop the cup 12. A trigger mechanism 18 is provided with a curved push bar 20 to seal and unseal a circular drinking aperture 16 in the upper transverse confining top wall 17 of the cap 14.

Figure 2:
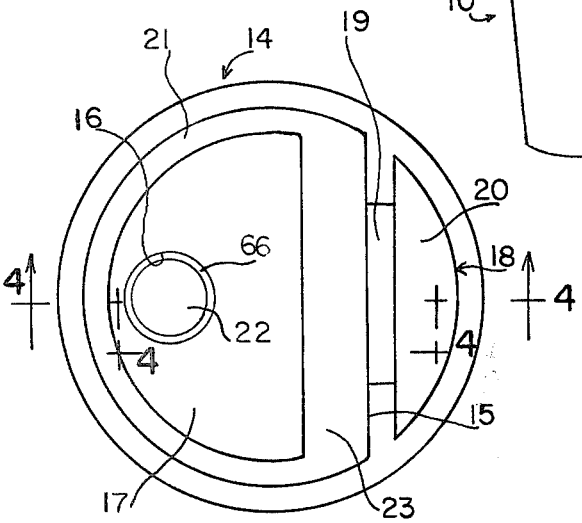
FIG. 2 is a top view of the container of FIG. 1.
Figure 3:
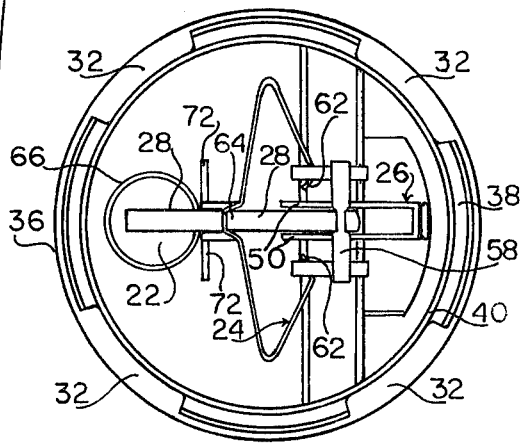
FIG. 3 is a view of the underside of the cap of the container of FIG. 1.
Figure 4:
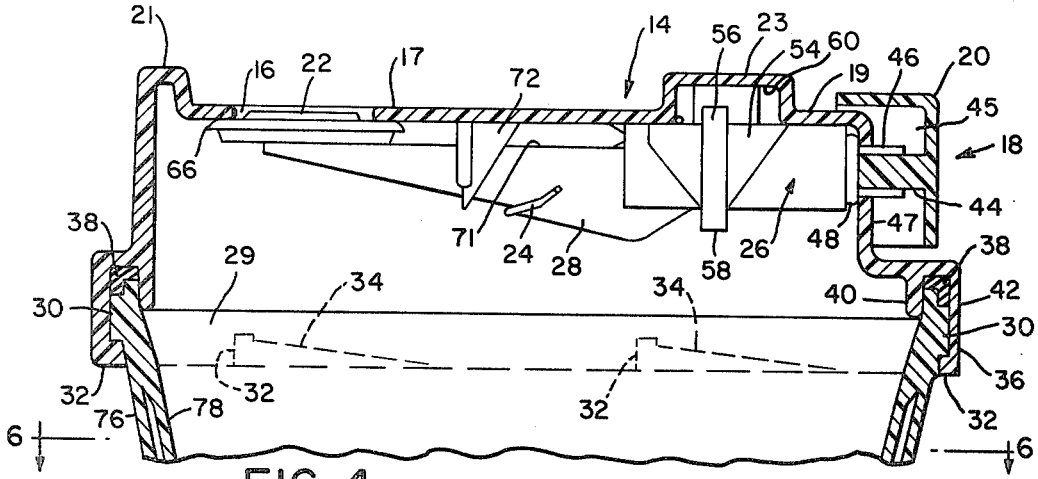
FIG. 4 is a partial elevational section taken along the lines 4—4 of FIG. 2.

The cap 14 is divided generally by a chordal demarkation at an otherwise upright cylindrical partition wall 15. From the center and lower portion of the chordal demarkation a ledge 19 continues in a radial extension. The partition wall 15 defines a larger portion of the cap with the drinking aperture 16 near the perimeter of its upper transverse top wall 17. The flat transverse top wall 17 is bounded by an arcuate rim 21, and by a transverse inverted channel 23. The partition wall 15 forms the exposed side of the channel 23. The radially projecting ledge 19 is positioned atop the smaller portion of the cap 14 and aids in guiding the trigger mechanism 18. The actuating push bar 20 has an outer surface shaped as a segment of a circle concentric relative to a portion of the circular upper lip 29 of the cup 12 and can be depressed toward the geometric center of the cap 14. The push bar 20 is best depicted in FIG. 2 and in FIGS. 8, 9 and 10. Within the cap, an interiorally located generally horizontal disk shaped plug 22 is biased into sealing engagement with the circular drinking opening 16. The plug 22 is biased into position by a steel wire spring 24, configured generally in the shape of a rhombus, but open at one obtuse angled corner, as depicted in FIG. 3. As indicated in FIG. 4, the wire spring 24 urges the plug 22 into sealing engagement to close the circular drinking aperture 16. The trigger mechanism 18 is connected to the plug 22 by a bifurcated shackle shaped plunger 26 and an elongated generally triangular shaped lever 28, depicted in FIGS. 3, 4 and 5.

The cap 14 is removably connected to the cup 12 by interacting twist lock members. The cup 12 is equipped at the outer surface of its lip 29 with separated spaced, arcuate radial ridges 30. The ridges 30 interact with similarly spaced inwardly directed arcuate camming ridges 32 on the rim 36 of the cap 14 having upwardly inclined ramp surfaces 34. The cap 14 is releasably engaged with the cup 12 by moving the cap 14 and cup 12 axially toward each other to force the camming ridges 32 of the cap 14 downwardly into the interstital spaces between the outwardly directed ridges 30 on the lip 29 of the cup 12. This positions the lower extremities of the ramp surfaces 34 below the level of the ridges 30. The cap 14 is then twisted clockwise relative to the cup 12 so that as the outwardly directed ridges 30 engage the ramp surfaces 34, the cap 14 is drawn more tightly onto the cup 12. An annular gasket 38, formed of rubber, polypropylene or polyvinylchloride in an L-shaped cross section, is entrapped between shallow concentric, circular, downwardly depending retaining partitions 40 and 42 at the rim 36 of the cap 14. The gasket 38 thereby forms a liquid tight seal with the upper circular edge of the lip 29 of the cup 12 when the cap 14 and cup 12 are twisted together.

Figure 8:
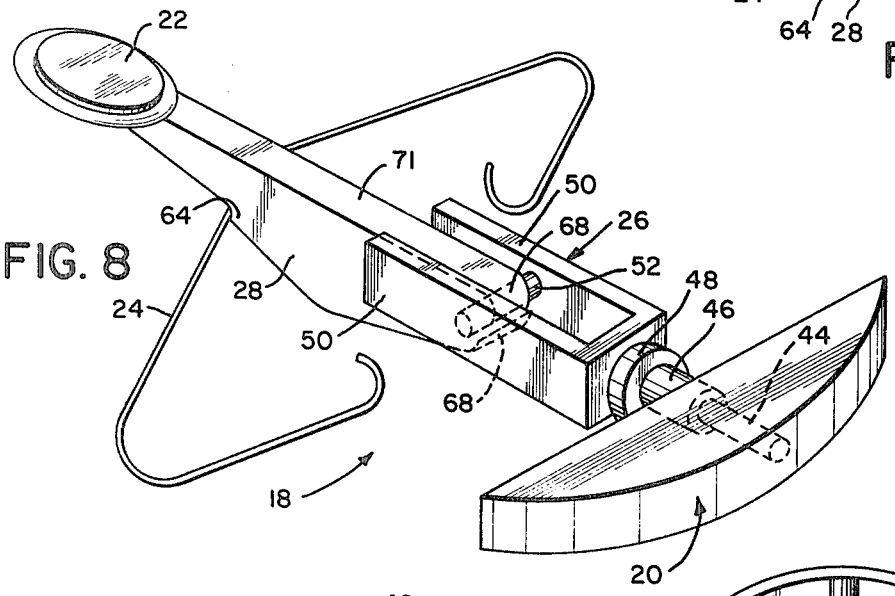
FIG. 8 is a perspective detail showing the trigger actuating mechanism of the invention.
Figure 10:
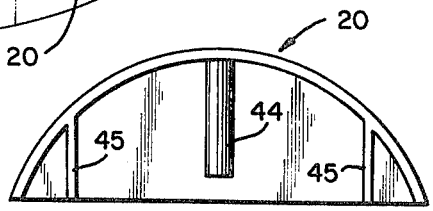
FIG. 10 is a bottom plan isolated view of the push bar of the invention.
Figure 9:
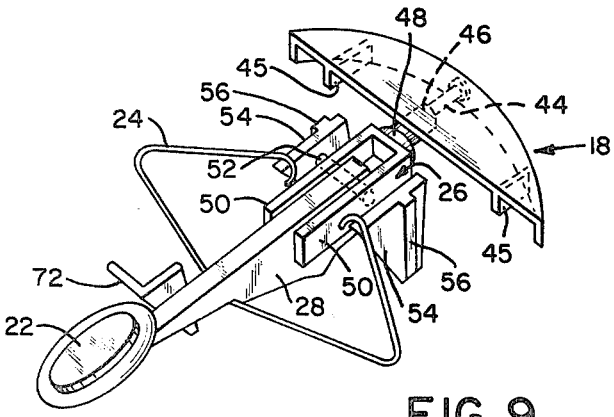
FIG. 9 is another perspective detail of the trigger actuating mechanism from a different vantage point.

The push bar 20 of the trigger mechanism 18 has an arcuate configuration as depicted in FIGS. 2 and 10, so that the index finger of the user falls easily into place against this surface when the container 10 is held in the hand of a user. The push bar 20 is of L-shaped cross section, as depicted in FIGS. 4 and 5, and includes a central radially directed cylindrical post 44 extending inwardly opposite its curved arcuate outer wall. Vertical guide partitions 45, best depicted in FIGS. 8–10, are disposed in spaced apart relation parallel to the post 44 and are rigidly connected to the push bar 20, and move in sliding engagement on either side of the lateral walls of the ledge 19 to guide the post 44 in its reciprocal radial movement. The radially directed post 44 is received within an annular sleeve 46 extending radially outward through the transverse sidewall 47 of the ledge 19 from the plunger 26. An annular sealing collar 48 of rubber, polyvinylchloride or other liquid impervious material is positioned about the sleeve 46 at its base.

Extending in the other direction, from the base of the sleeve 46, the plunger 26 is bifurcated into a pair of separated, parallel rectangular shaped legs 50 best illustrated in FIGS. 3 and 8–9. A cylindrical fulcrum rod 52, visible in FIGS. 5 and 8–9 extends transversely between the legs 50 to shackle the actuating lever 28 which moves the plug 22 relative to the drinking opening 16. The lever 28 moves rotationally in a plane parallel to and between the legs 50 of the plunger 26.

Triangular shaped mounting braces 54 depend downwardly and are glued to the underside of the transverse surface 17 of the cap 14. The braces 54 include raised reinforced stanchion sections 56 which terminate at their downward extremities in a crossbar 58 which passes therebetween and limits the downward movement of the lever 28. The inverted channel 23 on the top of the cap 14 forms a raised tunnel 60 across its inner surface adjacent to the center of the braces 54, so that a hollow space is formed between the center of the braces 54 and the inner surface of the cap 14. This construction allows feet 62 of the wire spring 24 to hook around the braces 54 which are glued to the underside of the cap 14. The wire spring 24 is a unitary structure which has opposing legs which diverge outward from engagement with a shoulder 64 on the lever 28 and extend outwardly in hairpin fashion to converge and terminate in the feet 62. From FIGS. 3–5 and 7–9 it can be seen that the wire spring 24 bears against the shoulder 64 to bias the lever 28 rearwardly toward the plunger 26 and also in rotation clockwise with a force normal to the underside of the transverse surface 17 of the cap 14 to bring the plug 22 upward into sealing engagement with the drinking opening 16. The plug 22 is equipped with a flat disk shaped polyvinylchloride sealing gasket 66, attached to the cantilevered extremity of the lever 28, to effectuate liquid tight sealing engagement of the plug 22 in the drinking opening 16.

Figure 7:
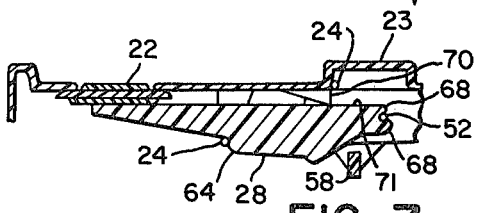
FIG. 7 is a sectional detail view similar to FIG. 5 except that the drinking opening is sealed.

The opposite end of the lever 28 terminates in a pair of parallel teeth 68 which bracket the fulcrum rod 52 extending between the legs 50 of the plunger 26 as illustrated in FIGS. 5 and 7–8. The spring 24 biases the lever 28 toward the plunger 26 so that it is held in position for rotational movement about the fulcrum rod 52. A pair of angle-shaped guides 72 depend downwardly from the underside of the transverse top wall 17 of the cap 14 to laterally restrain movement of the cantilevered end of the lever 28. The guides 72 include two triangular shaped portions of unequal height oriented at right angles to each other with their bases against the top wall 17. One of the guides 72 has been omitted from FIG. 9 so as to facilitate observation of the other.

At the underside of the transverse top wall 17 of the cap 14 and longitudinally aligned with the lever 28, there is a downwardly depending triangular shaped projection 70 which bears against the flat facing surface 71 of the lever 28 and is visible in FIGS. 5 and 7. The spring 24 is stressed to exert a force on the backside of the lever 28 at the shoulder 64 toward the top wall 17 of the cap 14 to hold the flat facing surface of the lever 28 in contact with the triangular shaped projection 70. The projection 70 serves as a cam to rotate the lever 28 counterclockwise against the bias of spring 24 when the trigger push bar 20 is depressed radially inward, as depicted in FIG. 5. The bias of the spring 24 will rotate the lever 28 clockwise to the position of FIG. 4, closing the opening 16, when the trigger 18 is released.

The cup 12 is thermally insulated by a double wall construction. An inner wall 74 is concentrically arranged relative to an outer wall 76 with an air space 78 therebetween. The inner and outer walls 74 and 76 respectively are joined together at their upper extermities by the lip 29 of the cup 12. The double wall construction depicted, together with the insulating effect provided by the cap 14, sufficiently insulates both hot and cold liquids within the container 10.

To drink from the container 10, the user twists the cap 14 counterclockwise from the engagement depicted in FIG. 1 and draws it free from the cup 12 with the camming ridges 32 moving longitudinally between the spaced outwardly directed ridges 30 of the cup 12. A beverage is poured into the cup 12 and the cap 14 is replaced and sealed with a clockwise twist which brings the gasket 38 into sealing engagement with the upper edge of the lip 29 of the cup 12. The container 10 is thereby totally sealed to prevent the beverage therein from leaking.

The gasket 38 provides a tight seal about the rim. The bias of the spring 24 provides a normal component of force against the lever 28 urging the plug 22 with its sealing disk 66 into liquid tight engagement with the drinking opening 16 in the transverse top wall 17. The spring 24 also exerts a radial component of force which drives the annular gasket 48 into sealing abutment with the transverse side wall 47 of the ledge 19 of the cap 14. Liquid is thereby totally enclosed in leak proof arrangement within the container 10. The contents remain within the container 10 despite tipping or inversion.

To drink the beverage from the container 10, the user grasps the cup 12 near its upper extremity in one hand with the thumb of the hand on the outer wall 76 of the cup 12 or on the side wall of the cap 14 near the drinking opening 16. The index finger of the user's hand curves over the arcuate push bar 20 with the remaining fingers falling into contact with the outer wall 76 of the container 12 below the push bar 12. When the user presses the push bar 20 of the trigger mechanism 18 radially inward toward the center of the cap 14, the inward force is transmitted through the rod 44 to the plunger 26. The inward movement of the plunger 26 carries the transverse fulcrum rod 68 toward the drinking aperture 16. The fulcrum rod 68 in turn forces lever 28 radially inward toward the cup 12 against the bias of the wire spring 24. The camming projection 70 increases the angle of the lever 28 relative to the underside of the upper transverse top wall 17 of the cap 14, thereby rotating the lever 28 counterclockwise. This draws the plug 22 away from the drinking opening 16. The user tilts the container 10 and concurrently positions his lips in contact with the drinking opening 16. As the container 10 is tilted the beverage flows through the drinking opening 16 for consumption by the user. When the user withdraws pressure from the trigger mechanism 18 by removing his index finger therefrom, the bias of the spring 24 urges the plug 22 into sealing engagement with the drinking opening 16 and also returns the gasket 46 into abutting relationship with the side wall 15 of the cap 14. The container is then totally sealed again, as depicted in FIG. 4.

While but a single embodiment of the invention has been illustrated, it should be understood that numerous variations and modifications will undoubtedly become readily apparent to those skilled in the art. Accordingly, the precise design and structure of the invention should not be limited to that depicted in the drawings, but rather is defined in the claims appended hereto.

I claim:

1. A sealable drinking container comprising:

a cup having a circular upper lip, a cap having a confining upright side wall and a transverse confining top wall having an undersurface and releasably engageable with the upper lip of said cup in transverse arrangement thereacross in a liquid tight seal, and having a drinking opening near the perimeter of said top wall, a plug moveably positionable in said drinking opening of said cap, trigger actuating means including a transverse push bar having an arcuately curved outer surface located externally to said cap beyond said confining upright wall, and adjacent the undersurface of said top wall and concentric relative to a portion of said circular upper lip, a unitary laterally moveable plunger having a post extending through a portion of said confining side wall of said cap into engagement with said push bar, a U-shaped bifurcated shackle having separated, parallel legs extending inwardly from said post within said confining side wall of said cap, an elongated lever having opposite ends and of uniform thickness and with a flat surface facing said top wall and connected to said plug at one end and rotatably mounted between said legs of said shackle at the other end for rotational movement in a plane parallel to said legs of said shackle, and with a lever shoulder defined therein on a side opposite said flat surface, guide means including a cam surface on said cap against which said flat surface of said lever bears, and unitary spring biasing means including a unitary wire spring having a pair of legs which terminate in feet releasably secured relative to said cap and which diverge outward from engagement with said lever shoulder and bear thereagainst to bias said lever linearly to force said push bar radially outwardly from said cap and which bias said lever in rotation to rotate said plug toward engagement with said drinking opening, whereby depression of said push bar toward said confining upright wall of said cap carries said shackle toward said drinking opening so that said end of said lever attached to said shackle moves toward said drinking opening forcing the flat surface thereof facing said top wall against said cam surface which rotates said lever and said plug inwardly from said cup out of engagement with said drinking opening when said trigger is actuated.

2. A drinking container according to claim 1 further characterized in that said wire spring is generally in the shape of a rhombus and has a pair of legs which diverge at an obtuse angle from engagement with said trigger actuating means at said lever shoulder and extend outwardly to form acute angles remote from said lever and to converge at their extremities and terminate at connections hooked to said cap.

3. A sealable drinking container according to claim 1 further comprising a twist lock for sealing said cap to said cup.

* * * * *

Disclaimer 4,212,408.—*Joseph F. Valenzona*, Harbor City, Calif. Patent dated July 15, 1980. BEVERAGE DRINKING CONTAINER. Disclaimer filed Mar. 29, 1989, by the assignee, Mr. Gasket Co.

Hereby enters this disclaimer to the entire term of said patent.

[*Official Gazette May 23, 1989* ]